US006948269B2

(12) United States Patent
Wang

(10) Patent No.: US 6,948,269 B2
(45) Date of Patent: Sep. 27, 2005

(54) SIZE TAG CLIP

(76) Inventor: Shu-Fen Wang, P.O. Box No. 6-57, Junghe, Taipei 235 (TW)

( * ) Notice: Subject to any disclaimer, the term of this patent is extended or adjusted under 35 U.S.C. 154(b) by 8 days.

(21) Appl. No.: 10/665,125

(22) Filed: Sep. 22, 2003

(65) Prior Publication Data

US 2005/0060851 A1 Mar. 24, 2005

(51) Int. Cl.[7] ..... A47G 24/14
(52) U.S. Cl. ..... 40/322; 24/561; 223/85
(58) Field of Search ..... 24/561, 457; 223/85; 40/322

(56) References Cited

U.S. PATENT DOCUMENTS 5,305,933 A * 4/1994 Zuckerman ..... 223/85
5,449,099 A * 9/1995 Blanchard ..... 223/85
5,524,801 A * 6/1996 Dooley et al. ..... 223/85
5,687,887 A * 11/1997 Bond et al. ..... 223/85
2003/0019137 A1 * 1/2003 Giustini et al. ..... 40/322

* cited by examiner

*Primary Examiner*—James R. Brittain
(74) *Attorney, Agent, or Firm*—Troxell Law Office, PLLC

(57) ABSTRACT

A size tag clip on a hanger including an external protruding plate on which are symmetrical sloping top surfaces. The sides at the top of the sloping surface are flat but the bottom part are two matching sloping protrusions that form a tiny ditch with the hanger. When inserting the size tag into the size tag clip, the sloping surfaces will expand the opening of the size tag which, after passing through the sloping protrusions will snap tight the size tag with the size tag clip. Inversely, rotate the size tag rendering the size tag clip a little slanted to force the opening of the size tag to expand to become bigger than the thickness of the external protruding plate, making the size tag to slide past the sloping protrusions easily when taking off the size tag from the size tag clip.

3 Claims, 4 Drawing Sheets

SIZE TAG CLIP

BACKGROUND OF THE INVENTION (a) Field of the Invention

The invention relates to a size tag clip on a hanger. The size tag clip of a hanger consists of an external protruding plate on which are symmetrical sloping top surfaces. The sides at the top of the sloping surface are flat but the bottom part are two matching sloping protrusions that form a tiny ditch with the hanger.

When inserting the size tag into the size tag clip, the sloping surfaces will expand an opening of the size tag which, after passing through the sloping protrusions will snap tight the size tag with the size tag clip.

Inversely, rotate the size tag rendering the size tag clip a little slanted to force the opening of the size tag to expand to become bigger than the thickness of the external protruding plate, making the size tag to slide past the sloping protrusions easily when taking off the size tag from the size tag clip.

(b) Description of the Prior Art

Referring to FIG. 1, a size tag clip C on a hanger A utilizes a protruding clip C1 to snap B1 of a size tag B. When the size tag B snaps with the size tag clip C, due to a higher position of the protruding clip than that of the opening of the size tag B, inserting the size tag requires more effort; the same for retracting the size tag B, making use inconvenient.

How to amend the inconvenience is thus the difficult objective of this invention.

SUMMARY OF INVENTION

The invention relates to an improvement on the structure of a size tag clip which, referring to FIGS. 2 and 3, consists of a protruding plate D1 on a size tag clip D of a hanger A. The protruding plate D1 has two symmetrical top surfaces D4 which have downward sloping protrusions D3, wherein sides D2 adjacent to a tip D7 of the protruding plate D1 are perpendicularly cut surfaces. Corresponding to the tip D7 is a more tilted sloping surface D5 which forms a ditch D6 with the hanger A.

Referring to FIG. 4, face opening B2 of a size tag B to the tip D7 of the protruding plate D1 when inserting the size tag B into the size tag clip D. At this time, the downward sloping protrusions D3 will extend the opening B2 open and after a snap B1 passes through the top surfaces D4 and the sloping surface D5 into the ditch D6, the assembly is complete.

Inversely, when retracting, rotate the sides of the size tag B to make the size tag B slanted to force open the opening B2, rendering the opening B2 bigger than the protruding plate D1 to allow passage through the sloping surfaces D5.

To enable a further understanding of the said objectives and the technological methods of the invention herein, the brief description of the drawings below is followed by the detailed descriptions of the prior art and of the preferred embodiment.

DETAILED DESCRIPTION OF THE PREFERRED EMBODIMENTS

Figure 1:
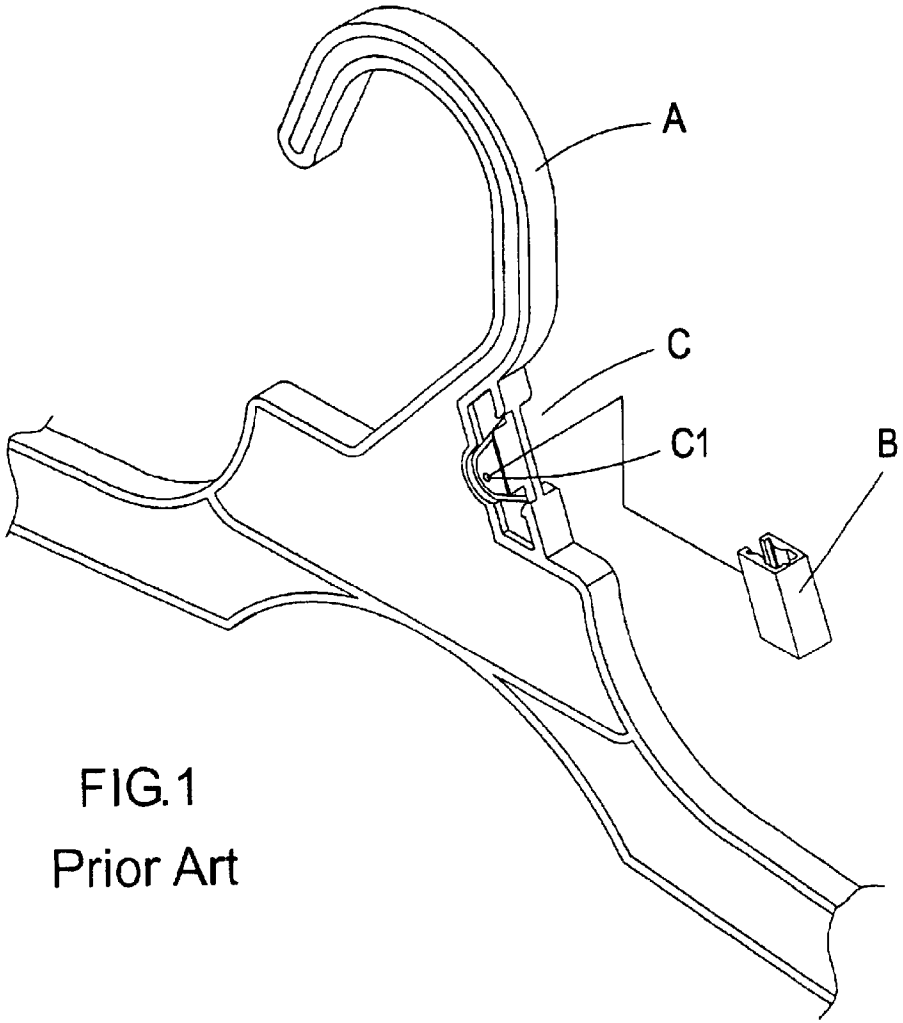
FIG.1 Prior Art
FIG. 1 shows a perspective view of the external structure according to the prior art.
Figure 2:
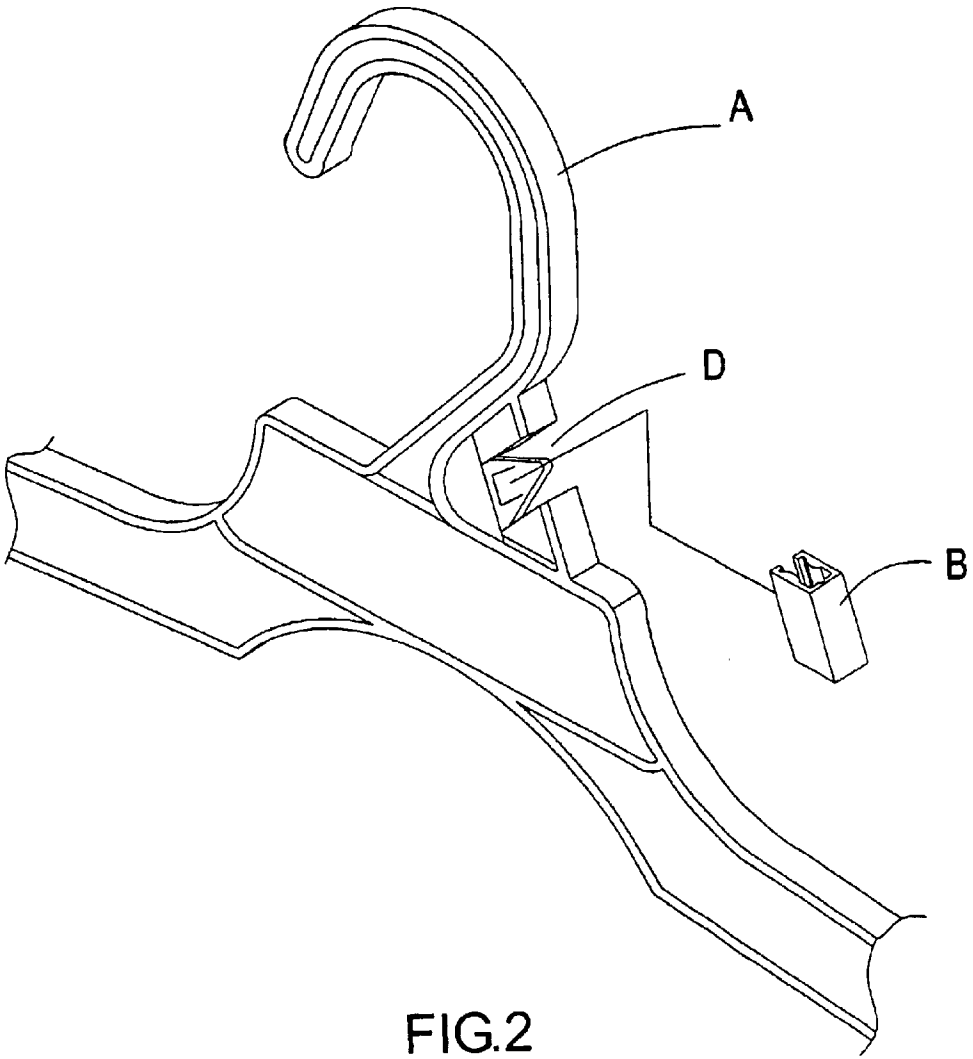
FIG. 2 shows a perspective view of the external structure according to the invention.
Figure 3:
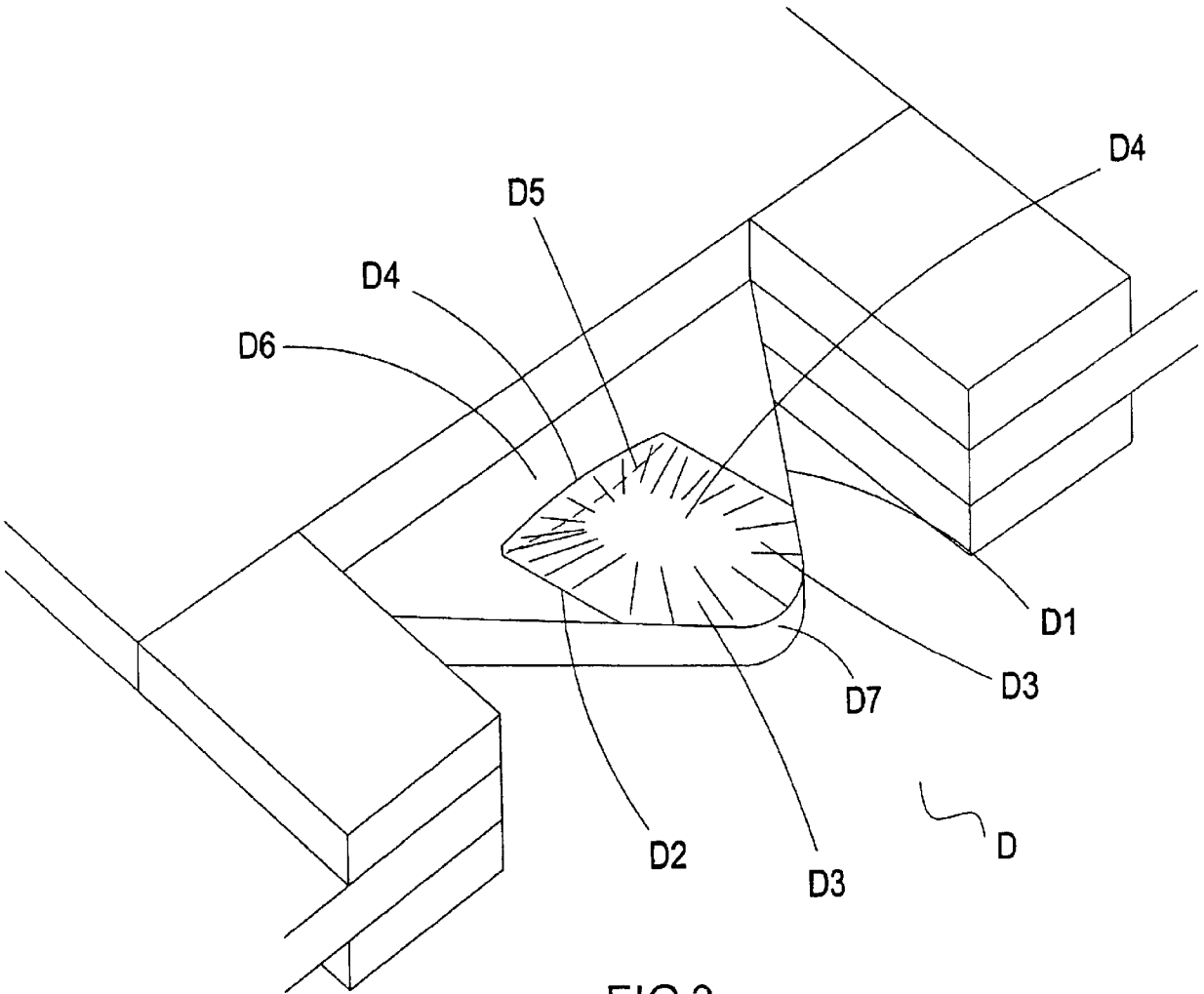
FIG. 3 shows an enlarged view of a part of the invention.
Figure 4:
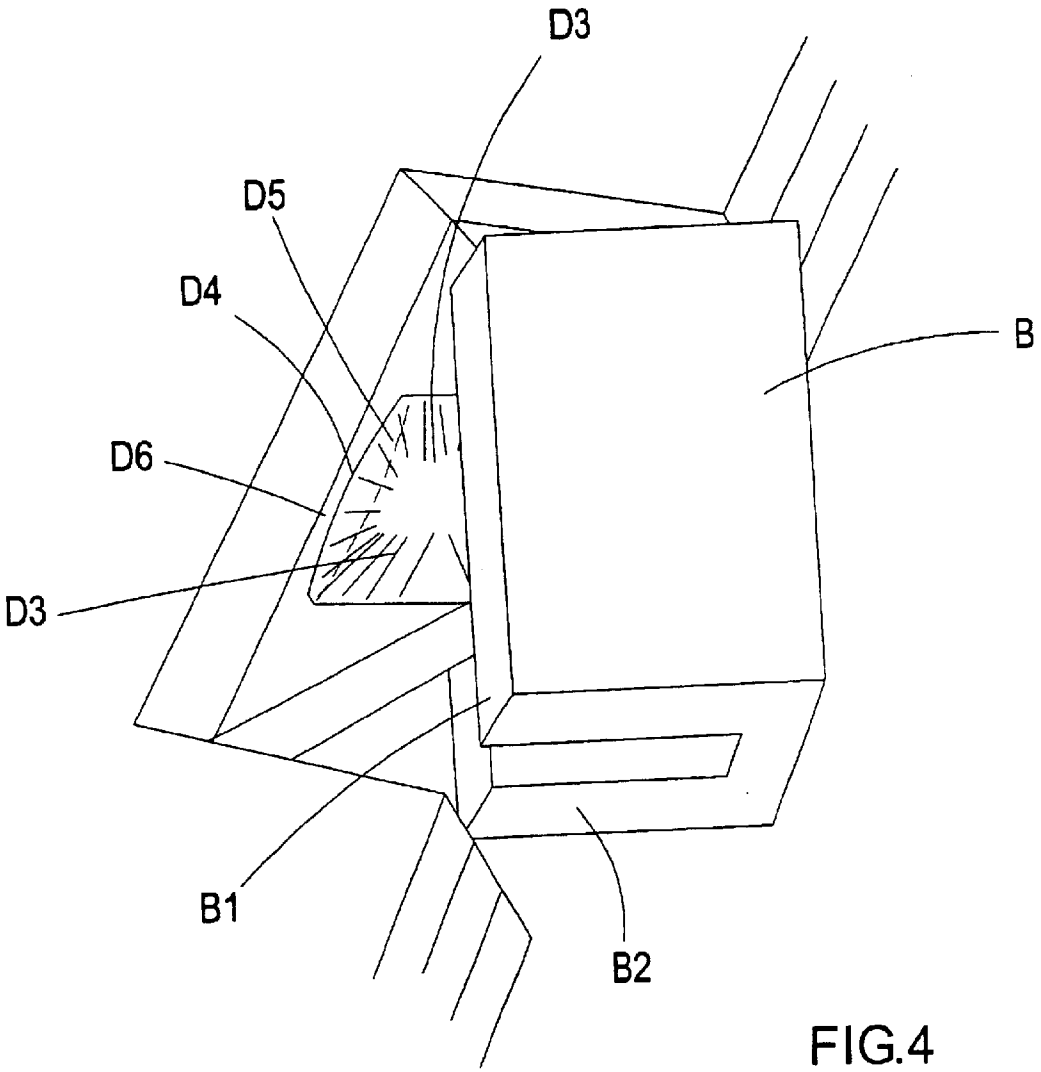
FIG. 4 shows a view of operation of the invention.

The invention relates to an improvement on the structure of a size tag clip. Referring to FIG. 4, face the opening B2 of the size tag B to the tip D7 of the protruding plate D1 when inserting the size tag B into the size tag clip D. At this time, the downward sloping protrusions D3 will extend the opening B2 open and after the snap B1 passes through the top surfaces D4 and the sloping surface D5 into the ditch D6, the assembly is complete.

Inversely, when retracting, rotate the sides of the size tag B to make the size tag B slanted to force open the opening B2, rendering the opening B2 bigger than the protruding plate D1 to allow passage through the sloping surfaces D5.

In order to extinguish the improved features of the invention from that of the prior art, a comparison is as follows 1. Prior Art (1) The size tag does not snap easily with the size tag clip.

(2) More effort is required to take off the size tag from the size tag clip thus wasting more time.

2. The invention (1) Taking off the size tag from the size tag clip is fast and easy.

(2) The assembled unit is stronger.

(3) Improvement and practicality are exhibited.

(4) Competitiveness of the industry is enhanced.

In conclusion, the invention not only has achieved breakthrough improvement but also has attained the desired improved functionality, not demonstrated in the prior art and by its inventor. Moreover, the invention has not become public, and its nature and practicality have complied with the conditions of applying for a paten, therefore application for a patent is engendered.

It is of course to be understood that the embodiment described herein is merely illustrative of the principles of the invention and that a wide variety of modifications thereto may be effected by persons skilled in the art without departing from the spirit and scope of the invention as set forth in the claims.

What is claimed is:

1. A size tag clip assembly for a hanger comprising:

a) a size tag clip located on the hanger and having a protruding plate with a triangular shape and having:

i) a tip;

ii) two symmetrical surfaces, each of the two symmetrical surfaces having downwardly sloping protrusions and side surfaces located perpendicular to and adjacent to the tip;

iii) an upwardly sloping surface; and iv) a ditch formed between the tilted sloping surface and the hanger; and b) a size tag having a snap and a face opening located in the snap, the size tap being removably connected to the size tag clip, wherein, when the size tag is connected to the size tap clip, the snap is located in the ditch and the tilted sloping surface extending into the face opening.

2. The size tag clip assembly according to claim 1, wherein an angle of the upwardly tilted sloping surface is greater than an angle of the downwardly sloping protrusions.

3. The size tag clip assembly according to claim 1, wherein the protruding plate is connected to one side of the hanger.

* * * * *